US010777914B2

(12) United States Patent
Frank et al.

(10) Patent No.: US 10,777,914 B2
(45) Date of Patent: Sep. 15, 2020

(54) EARTHING PIN FOR A MOTOR VEHICLE

(71) Applicant: Bayerische Motoren Werke Aktiengesellschaft, Munich (DE)

(72) Inventors: Wolfgang Frank, Unterfoehring (DE); Stefan Klein, Germering (DE); Susanne Wolfinger, Grafing-Bahnhof (DE); Frederik Von Der Halben, Karlsfeld (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/567,921

(22) Filed: Sep. 11, 2019

(65) Prior Publication Data

US 2020/0006871 A1 Jan. 2, 2020

Related U.S. Application Data

(63) Continuation of application No. PCT/EP2018/055227, filed on Mar. 2, 2018.

(30) Foreign Application Priority Data

Mar. 14, 2017 (DE) ..... 10 2017 204 197

(51) Int. Cl.
*H01R 4/66* (2006.01)
*H01R 4/64* (2006.01)
(Continued)

(52) U.S. Cl.
CPC ..... *H01R 4/64* (2013.01); *H01R 4/26* (2013.01); *H01R 11/28* (2013.01); *H01R 2201/26* (2013.01)

(58) Field of Classification Search
CPC . H01R 4/26; H01R 4/64; H01R 4/643; H01R 4/66; H01R 11/28; H01R 2201/26
(Continued)

(56) References Cited

U.S. PATENT DOCUMENTS 5,441,417 A 8/1995 Ladouceur et al.
7,892,049 B1 2/2011 Andler et al.
(Continued)

FOREIGN PATENT DOCUMENTS

CN 204596866 U 8/2015
DE 44 25 839 A1 1/1996
(Continued)

OTHER PUBLICATIONS

PCT/EP2018/055227, International Search Report dated Jun. 1, 2018 (Three (3) pages).
(Continued)

*Primary Examiner* — Khiem M Nguyen
(74) *Attorney, Agent, or Firm* — Crowell & Moring LLP

(57) ABSTRACT

A grounding pin for connecting a vehicle body to a pole of a vehicle battery includes a pin plate and a pin shaft. The pin shaft protrudes from the pin plate, the pin shaft includes an external thread, and a longitudinal axis of the pin shaft forms a center line of the grounding pin. The pin plate has an installation securing face which points radially outward and which is parallel to a face which passes through the center line. The installation securing face is disposed closer to the center line than a circumferential face of the pin plate. The pin plate has a connection face which points away from the pin shaft and which is matched to the vehicle body for a welding purpose.

8 Claims, 3 Drawing Sheets

(51) Int. Cl.
*H01R 4/26* (2006.01)
*H01R 11/28* (2006.01)

(58) Field of Classification Search
USPC ..... 439/92, 102, 103, 108
See application file for complete search history.

(56) References Cited

U.S. PATENT DOCUMENTS

| | | | |
|---|---|---|---|
| 2003/0017391 | A1 | 1/2003 | Peterson et al. |
| 2008/0032570 | A1 | 2/2008 | Hitomi et al. |
| 2015/0155642 | A1 | 6/2015 | Kim et al. |
| 2016/0250984 | A1 | 9/2016 | Gottschlich et al. |

FOREIGN PATENT DOCUMENTS

| | | | |
|---|---|---|---|
| DE | 10 2004 060 814 | A1 | 6/2006 |
| DE | 10 2008 019 852 | A1 | 10/2009 |
| JP | 2011-108633 | A | 6/2011 |

OTHER PUBLICATIONS

German Search Report issued in German counterpart application No. 10 2017 204 197.8 dated Jul. 10, 2017 (Nine (9) pages).
Chinese Office Action issued in Chinese application No. 201880014879.1 dated Jun. 4, 2020 (Eight (8) pages).

EARTHING PIN FOR A MOTOR VEHICLE

CROSS REFERENCE TO RELATED APPLICATIONS

This application is a continuation of PCT International Application No. PCT/EP2018/055227, filed Mar. 2, 2018, which claims priority under 35 U.S.C. § 119 from German Patent Application No. 10 2017 204 197.8, filed Mar. 14, 2017, the entire disclosures of which are herein expressly incorporated by reference.

BACKGROUND AND SUMMARY OF THE INVENTION

The invention relates to a grounding pin for connecting a vehicle body to a pole of a vehicle battery, a grounding pin connection with such a grounding pin, and a motor vehicle with such a grounding pin or grounding pin connection.

FIG. 1 shows a known grounding pin 1 for connecting a vehicle body to a minus pole of a vehicle battery. The grounding pin 1 has a pin plate 2 from which a pin shaft 3 protrudes, the pin shaft being provided with an external thread. A cable lug of a line leading to the vehicle battery can be fastened to the grounding pin 1. More precisely, the cable lug is mounted on the grounding pin 1 such that the pin shaft 3 extends through the opening of the cable lug and is then screwed tight by means of a nut on the pin shaft 3 on the grounding pin 1. One end of the cable lug opposite the line is provided with an angle section, which encloses the pin plate 2 so that the cable lug can only be oriented in one of the four predetermined positions, each set off from the others by 90°. When attaching the grounding line one must pay attention that a particular orientation of the cable lug is required, or else the cable guidance of the grounding line is not optimal or not possible as intended. This particular orientation may vary according to the vehicle model. Due to the variable orientation possibility, however, a wrong orientation or wrong installation is possible, which might then become evident during the laying of the line, for example, but unnecessary work time is squandered.

One problem which the present invention proposes to solve is to provide a grounding pin for connecting a vehicle body to a pole of a vehicle battery, which heightens the installation safety.

According to one exemplary embodiment of the invention, a grounding pin is provided for connecting a vehicle body to a pole of a vehicle battery, comprising a pin plate and a pin shaft which protrudes from the pin plate and is provided with an external thread and the longitudinal axis of which forms a center line of the grounding pin, wherein the pin plate has a single or two installation securing faces which point radially outward and which are each parallel to a face which passes through the center line, wherein a minimum distance between a circumferential face of the pin plate and the center line lies in the range of the installation securing face/faces, and wherein the pin plate is provided with a connection face which points away from the pin shaft and is matched to the vehicle body for welding purposes. Because the installation securing face creates a region forming the circumferential region with the smallest distance in relation to the overall circumferential face, a cable lug can only be mounted in a predefined orientation on the grounding pin, which creates installation safety.

According to a further exemplary embodiment of the invention, the circumferential face of the pin plate is round outside of the installation securing face/faces.

According to a further exemplary embodiment of the invention, contact wedge elements are provided around the pin shaft, each of them having an edge which starts at the radially outward pointing face of the pin shaft and extends at a slant away from the pin shaft and toward the pin plate. Thanks to these contact wedge elements, the junction resistance between the cable lug and the grounding pin is decreased.

According to a further exemplary embodiment of the invention, the pin plate on the side facing toward the pin shaft has two parallel faces, of which an outer face surrounds an inner face as a ring and the inner face is situated closer to the pin shaft along the center line than the outer face.

According to a further exemplary embodiment of the invention, the pin shaft is provided with an external thread, especially an M8 thread or larger. It has been found that a thread of size M8 is best suited for the function of a grounding pin in motor vehicles.

According to a further exemplary embodiment of the invention, the connection face is provided with welding elevations, especially welding elevations that are suitable for a hump welding.

According to a further exemplary embodiment of the invention, the installation securing face extends in a straight line and entirely through the pin plate. This installation securing face extending entirely through the pin plate is easy and thus cost-effective to produce.

According to a further exemplary embodiment of the invention, the installation securing face is the surface of a groove, so that on either side of the installation securing face there are situated side flanks of the groove.

Furthermore, the present invention provides a grounding pin connection with a grounding pin according to one of the preceding exemplary embodiments and a cable lug, which can be fastened on one end of a cable and has an angle section at its end opposite the cable, which lies against the installation securing face.

Moreover, the present invention provides a motor vehicle with such a grounding pin or such a grounding pin connection.

In the following, a preferred exemplary embodiment of the present invention shall be described, making reference to the accompanying drawings.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
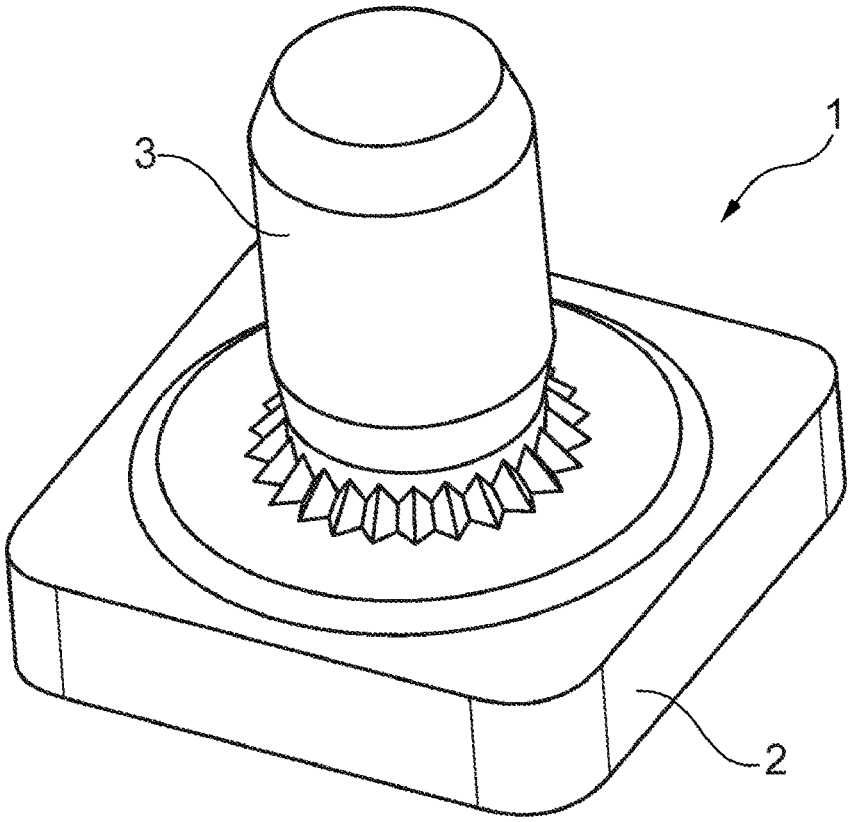
Fig. 1 Prior art
FIG. 1 is a three-dimensional representation of a grounding pin of the prior art.
Figure 2:
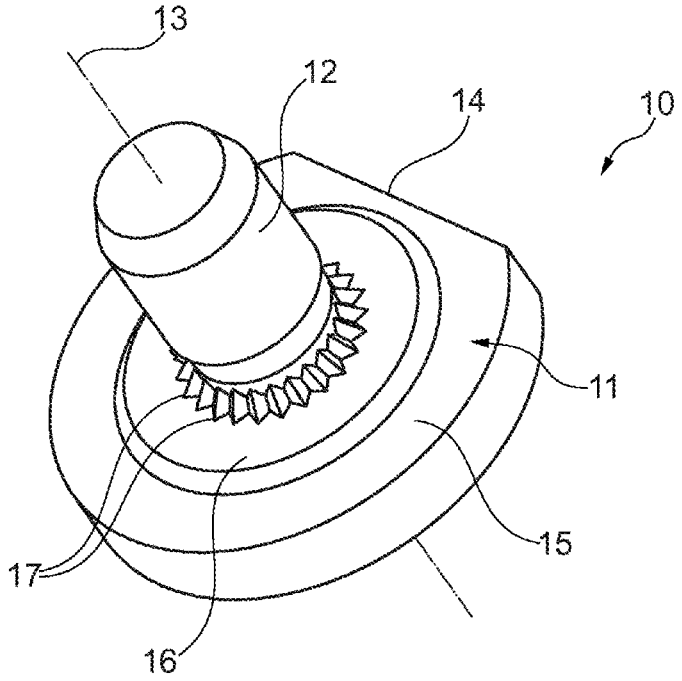
FIG. 2 is a three-dimensional representation of a grounding pin according to a first exemplary embodiment of the invention.

FIG. 2 is a three-dimensional representation of a grounding pin 10 according to a first exemplary embodiment of the invention. The grounding pin 10 comprises a pin plate 11 and a pin shaft 12 protruding from the latter. The pin shaft 12 is provided with an external thread. A longitudinal axis or a center line of the pin shaft 12 forms a center line 13 of the grounding pin 10. The pin plate 11 in the exemplary embodiment shown has a single installation securing face 14. The installation securing face 14 is a flat surface extending parallel to a plane passing through the center line 13. It is also possible to provide two such installation securing faces 14, which are preferably situated directly adjacent to each other. Except for the installation securing faces 14, the pin plate 11 has a round circumference. The installation securing face 14 extends entirely through the pin plate 11, parallel to a plane drawn through the center line and at a distance from the latter. The side of the pin plate 11 facing toward the pin shaft 12 has two parallel faces, which run substantially perpendicular to the center line 13, one outer face 15 surrounding an inner face 16 as a ring. The inner face 16, in regard to the center line 13, lies closer to the pin shaft 12 than the outer face 15. In the connection area between the pin shaft 12 and the pin plate 11, contact teeth 17 are provided (only some of them being provided with reference numbers). The contact teeth 17 are arranged in a row around the end of the pin shaft 12 at the pin plate side. An edge of each contact tooth 17 starting from the radially outward pointing side of the pin shaft 12 extends in a straight line away from the pin shaft 12 and toward the pin plate 11, so that this edge is oriented for example at 45° with respect to the center line 13. Starting from this edge, the contact tooth 17 broadens out in wedge fashion toward the pin plate 11. The distance (measured along a normal of the installation securing face 14 passing through the center line 13) between the installation securing face 14 and the center line 13 is shorter than the distance between the rest of the circumferential face, outside the installation securing face(s) 14, and the center line 13.

The grounding pin 10 is preferably made of steel and is put into the described shape in particular by pressing. The installation securing face 14 may be formed already by the pressing process, although it is preferably formed after the pressing by milling or cutting. The external thread of the pin shaft 12 is formed on the pin shaft 12 after the pressing process.

Figure 3:
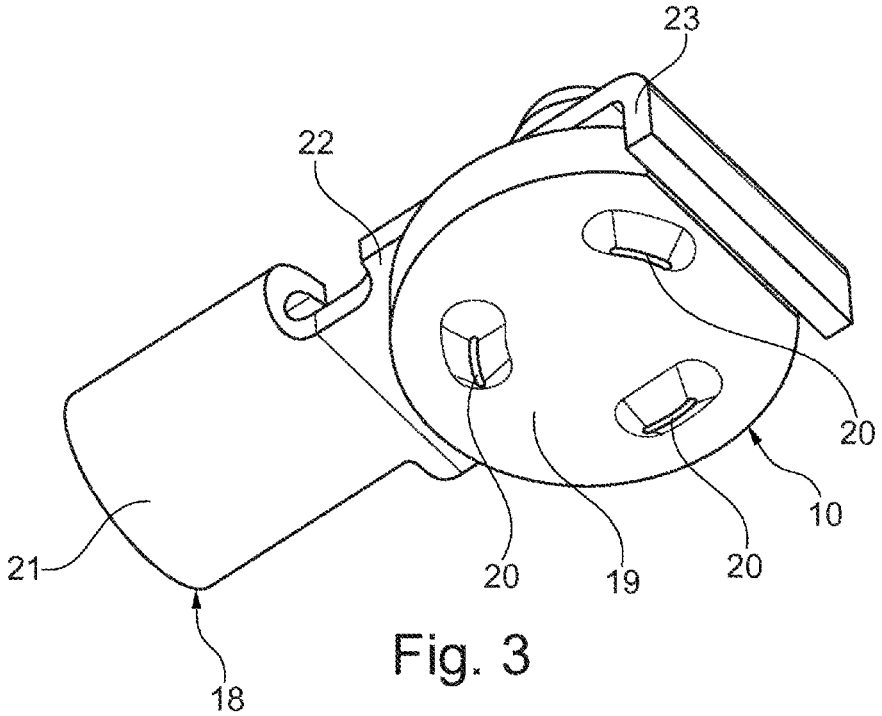
FIG. 3 is a three-dimensional representation of a grounding pin connection with a grounding pin and a cable lug according to a first exemplary embodiment of the invention.

FIG. 3 is a three-dimensional representation of a grounding pin connection with the grounding pin 10 of FIG. 2 and a cable lug 18. The side of the pin plate 11 facing away from the pin shaft 12 is fashioned as a connection face 19. This connection face 19 is adapted to being welded to a vehicle body. More precisely, a plurality of welding elevations 20 are provided for this purpose, which taper in the form of elevations in the direction away from the connection face 19. For the welding on of the grounding pin 10, an electrode of a welding apparatus is placed against the locations of the welding elevations 20, but on the opposite side to the connection face 19, and the grounding pin 10 is energized with current. The current flowing through the welding elevations 20 causes the welding elevations 20 to melt at least partly, so that the connection face 19 is fastened to the vehicle body.

The cable lug 18 has a cuff 21, in which one end of the grounding line leading to a vehicle battery (more precisely, to a minus pole of the vehicle battery) can be fixedly clamped. From the cuff 21 there extends a fastening section 22 of the cable lug 18, having a continuous opening. In the fastened state, the pin shaft 12 extends through the continuous opening and the fastening section 22 is screwed fast by a nut screwed onto the external thread of the pin shaft 12, whereupon the contact teeth 17 are pressed into the material of the cable lug 18 and thus ensure a better contact. For an installation-safe fastening of the cable lug 18 on the grounding pin 10, the installation securing face 14 is provided. At the end of the cable lug 18 situated opposite the cuff 21, the cable lug 18 is provided with an angle section 23. More precisely, the angle section 23 and the fastening section 22 form substantially a 90° angle, with the angle section extending in the direction away from the pin shaft 12. In the mounted state of the cable lug 18, the angle section 23 lies against the installation securing face 14. Since the installation securing face 14 is situated closer to the center line 13 than the rest of the circumferential face of the pin plate 11, due to the interaction between angle section 23 and installation securing face 14 the cable lug 18 can only be secured in this position which is predetermined due to the orientation of the installation securing face 14 during automated welding. Neither is a twisting of the mounted cable lug 18 possible any longer (except for a certain tolerance) after the angle section 23 lies against the installation securing face 14.

Figure 4:
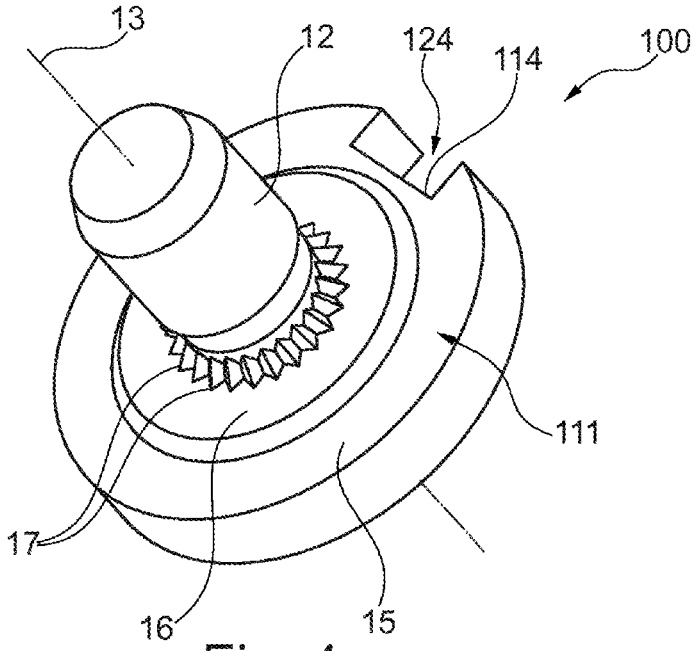
FIG. 4 is a three-dimensional representation of a grounding pin according to a second exemplary embodiment of the invention.
Figure 5:
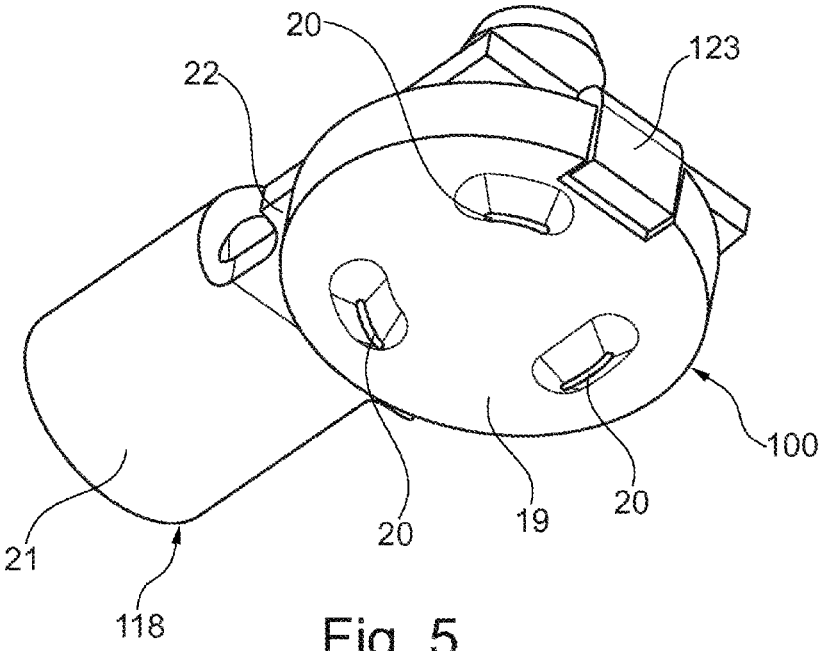
FIG. 5 is a three-dimensional representation of a grounding pin connection with a grounding pin and a cable lug according to a second exemplary embodiment of the invention.

FIG. 4 is a three-dimensional representation of a grounding pin 100 according to a second exemplary embodiment of the invention. FIG. 5 is a three-dimensional representation of a grounding pin connection with the grounding pin 100 and a cable lug 118. In order to avoid repetition, for this second exemplary embodiment only differences from the first exemplary embodiment will be described and except for these differences reference is made to the description of the first exemplary embodiment.

The pin plate 111 of the second exemplary embodiment differs from the pin plate 11 of the first exemplary embodiment only in that the installation securing face 114 does not extend entirely through the pin plate 111, but instead is a surface of a groove 124. That is, on either side of the installation securing face 114 there are provided side flanks of the groove 124 at a 90° angle. The statements regarding the minimal distance of the installation securing face 114, however, still hold, as in the first exemplary embodiment. The angle section 123 differs from the angle section 23 of the cable lug 118 in that it is narrower, so that it fits into the groove 124. The dimension of the angle section 123 in a direction parallel to the installation securing face 114 basically corresponds to the dimension of the installation securing face 114 in the same direction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A grounding pin for connecting a vehicle body to a pole of a vehicle battery, comprising:

a pin plate; and a pin shaft, wherein the pin shaft protrudes from the pin plate, wherein the pin shaft includes an external thread, and wherein a longitudinal axis of the pin shaft forms a center line of the grounding pin;

wherein the pin plate has an installation securing face which points radially outward and which is parallel to a face which passes through the center line;

wherein the pin plate has an outer circumferential face, wherein the installation securing face is disposed on the outer circumferential face, wherein the installation securing face is a flat surface, and wherein the outer circumferential face, except for the flat surface of the installation securing face, is round;

wherein the pin plate has a connection face which points away from the pin shaft and which is matched to the vehicle body for a welding purpose.

2. The grounding pin according to claim 1, wherein a plurality of contact wedge elements are disposed around the pin shaft and wherein each of the plurality of contact wedge elements have an edge which starts at a radially outward pointing face of the pin shaft and extends at a slant away from the pin shaft and toward the pin plate.

3. The grounding pin according to claim 1, wherein the pin plate on a side facing toward the pin shaft has an outer face and an inner face, wherein the outer face surrounds the inner face, and wherein the inner face is disposed closer to the pin shaft than the outer face.

4. The grounding pin according to claim 1, wherein the external thread of the pin shaft is an M8 thread or larger.

5. The grounding pin according to claim 1, wherein the connection face includes a welding elevation and wherein the welding elevation is suitable for a hump welding.

6. The grounding pin according to claim 1, wherein the installation securing face is a groove in the pin plate and wherein on a first side and a second side of the installation securing face there is disposed a respective side flank of the groove.

7. A grounding pin connection, comprising:

the grounding pin according to claim 1; and a cable lug, wherein the cable lug is fastenable on an end of a cable and has an angle section which lies against the installation securing face.

8. A motor vehicle with the grounding pin according to claim 1 or the grounding pin connection according to claim 7.

* * * * *